US010008790B2

(12) United States Patent
Kim

(10) Patent No.: US 10,008,790 B2
(45) Date of Patent: Jun. 26, 2018

(54) MAGNET TERMINAL WITH SOLDERLESS CONNECTION STRUCTURE AND JUMPER WIRE INCLUDING THE SAME

(71) Applicant: Korea University Research and Business Foundation, Seoul (KR)

(72) Inventor: Sughui Kim, Seoul (KR)

(73) Assignee: Korea University Research and Business Foundation, Seoul (KR)

( * ) Notice: Subject to any disclaimer, the term of this patent is extended or adjusted under 35 U.S.C. 154(b) by 0 days. days.

(21) Appl. No.: 15/159,954

(22) Filed: May 20, 2016

(65) Prior Publication Data

US 2016/0344117 A1 Nov. 24, 2016

(30) Foreign Application Priority Data

May 22, 2015 (KR) ..... 10-2015-0071727

(51) Int. Cl.

| | |
|---|---|
| ***H01R 11/30*** | (2006.01) |
| ***H01R 24/44*** | (2011.01) |
| ***H01R 24/58*** | (2011.01) |
| *H01R 4/72* | (2006.01) |

(52) U.S. Cl.
CPC ..... *H01R 11/30* (2013.01); *H01R 4/72* (2013.01)

(58) Field of Classification Search
CPC ..... H01R 11/36; H01R 4/70; H01R 11/18; H01R 11/30; H01R 13/6205; H01R 11/287; H01R 11/288; H01R 13/426; H01R 4/22; H01R 4/72; G09B 23/18; G09B 23/183; G09B 23/181; G09B 23/185; G09B 1/38; G01R 19/2513; G01R 19/2516; G01R 1/06788; G01R 1/16; G01R 27/16; G01R 31/02; G01R 31/026; G01R 31/041
See application file for complete search history.

(56) References Cited

U.S. PATENT DOCUMENTS

| | | | | |
|---|---|---|---|---|
| 4,112,941 A * | 9/1978 | Larimore | ..... | A61B 5/0416 439/153 |
| 5,779,487 A * | 7/1998 | Gatin | ..... | H01R 11/287 439/39 |
| 7,056,127 B2 * | 6/2006 | Suzuki | ..... | H01R 13/6205 439/22 |

(Continued)

FOREIGN PATENT DOCUMENTS

| | | |
|---|---|---|
| JP | H07034562 | 6/1995 |
| KR | 200306980 | 3/2003 |

(Continued)

OTHER PUBLICATIONS

English Translation of Japanese Utility Model Publication No. H07-034562, Jun. 26, 1995.*

*Primary Examiner* — Michael A Lyons
*Assistant Examiner* — Matthew T Dzierzynski
(74) *Attorney, Agent, or Firm* — Fox Rothschild LLP

(57) ABSTRACT

Disclosed is a magnet terminal and a jumper wire including the magnet terminal. The magnet terminal comprises a magnet layer, a metallic structure placed on the magnet layer and configured to conduct an electric signal with the magnet layer, and a tube configure to partly cover an outer surface of the metallic structure, then providing a low-cost solderless magnet terminal which is available for a component or electric/electronic circuit attachable to a magnet.

4 Claims, 7 Drawing Sheets

(56) References Cited

U.S. PATENT DOCUMENTS

| | | | | |
|---|---|---|---|---|
| 7,057,401 | B2 * | 6/2006 | Blades | G01R 31/041 324/424 |
| 7,264,479 | B1 * | 9/2007 | Lee | H01R 11/30 439/39 |
| 7,298,136 | B1 * | 11/2007 | Curtis | G01R 31/2834 324/754.03 |
| 7,874,844 | B1 * | 1/2011 | Fitts, Jr. | H01R 13/6205 439/218 |
| 8,016,599 | B1 * | 9/2011 | Melby | H01R 11/30 439/38 |
| 8,986,012 | B1 * | 3/2015 | McGee | G09B 23/02 434/211 |
| 9,025,787 | B2 * | 5/2015 | Tung | H01R 13/701 381/123 |
| 9,698,524 | B1 * | 7/2017 | Morgan | H01R 13/6205 |
| 2006/0084300 | A1 * | 4/2006 | Kowalski | A63H 33/046 439/100 |
| 2015/0333458 | A1 * | 11/2015 | Hallsten | H01R 24/58 439/39 |
| 2015/0349438 | A1 * | 12/2015 | Allen | H01R 13/6205 439/40 |
| 2016/0093995 | A1 * | 3/2016 | Carbone | H01R 13/426 439/733.1 |
| 2016/0225281 | A1 * | 8/2016 | Kim | G09B 19/0053 |

FOREIGN PATENT DOCUMENTS

| | | | |
|---|---|---|---|
| KR | 10-0730801 | B1 | 6/2007 |
| KR | 10-2008-0046048 | A | 5/2008 |
| KR | 2020100002485 | | 3/2010 |

* cited by examiner

MAGNET TERMINAL WITH SOLDERLESS CONNECTION STRUCTURE AND JUMPER WIRE INCLUDING THE SAME

CROSS-REFERENCE TO RELATED APPLICATIONS

A claim for priority under 35 U.S.C. § 119 is made to Korean Patent Application No. 10-2015-0071727 filed May 22, 2015, in the Korean Intellectual Property Office, the entire contents of which are hereby incorporated by reference.

BACKGROUND

Statement of Technical Field

The present disclosure relates to terminals die conduction line connection of electric and electronic experimental circuit boards. More particularly, the present disclosure relates to solderless magnet terminals capable of facilitating electrical connection with electric/electronic circuits or components which are attachable to magnets.

Description of Related Art

With rapid growth of Internet of Things (IoT) in recent years, open hardware is sprightly used in manufacturing hardware structures. There is arising a need of preparing apparatuses or tools intuitively and easily available for forming circuits even by a beginner who starts electric/electronic circuit connection and sensor connection for elementary training of IoT.

An apparatus, such as magnet bread board using magnetism combinable with a magnet or metal, developed according to such a need may allow a beginner to easily fabricate a circuit. Connection terminals or jumper wires including connection terminals according to the related art are insufficient to complete a circuit by connecting components on a magnet bread board.

As a prior art relevant to this technology, Korean Utility Publication No. 20-2010-0002458, entitled "Electric wire with small magnet for simple electric circuit", discloses a conductive cylindrical magnet, a magnet folder coincidentally having a magnet inserting structure with a properly-narrowed diameter to prevent a magnet from easy separation and with conductivity that allows easy insertion in fabrication by some elasticity, while wrapping side edges of two polarities of the magnet, and having a folding margin for pressing and connecting an electric wire, and a magnet-attached electric wire formed of an electric wire.

SUMMARY

The present disclosure concerns a solderless magnet terminal allowing easy connection with an electric apparatus, which is attachable to a magnet, in low cost.

A magnet terminal may include a magnet layer, a metallic structure placed on the magnet layer and configured to conduct an electric signal with the magnet layer, and a tube configured to partly cover an outer surface of the magnet layer and the metallic structure.

The metallic structure may include a first metallic structure placed on the magnet layer and configured to conduct an electric signal with the magnet layer, and a second metallic structure placed on the first metallic structure and configured to conduct an electric signal with the first metallic structure.

The first metallic structure and the second metallic structure may be shaped in cylinders. The first metallic structure may be larger than the second metallic structure in diameter. The first metallic structure may be lower than the second metallic structure in height.

The second metallic structure may be shaped in a hollow cylinder including an insertion part.

The tube may be shaped in a cylinder that is hollow, and may be a thermo-shrinking tube that is shrinkable by heat The magnet layer and the metallic structures may include one or more groove parts, wherein the tube may include one or more projection parts combined with the one or more groove parts.

In some scenarios, a jumper wire may include a magnet terminal, and a connection wire configured to conduct an electric signal with the magnet terminal and physically separable from or combinable with the magnet terminal.

BRIEF DESCRIPTION OF THE FIGURES

The above and other objects and features will become apparent from the following description with reference to the following figures.

Throughout the figures, like reference numerals refer to like parts unless otherwise specified.

DETAILED DESCRIPTION

Embodiments will now be described in detail with reference to the accompanying figures. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques will not be described with respect to some of the embodiments of the inventive concept. In the figures, the sizes and relative sizes of layers and regions may be exaggerated for clarity.

Hereinafter, a magnet terminal will be described in conjunction with FIGS. 2 and 3.

Figure 2:
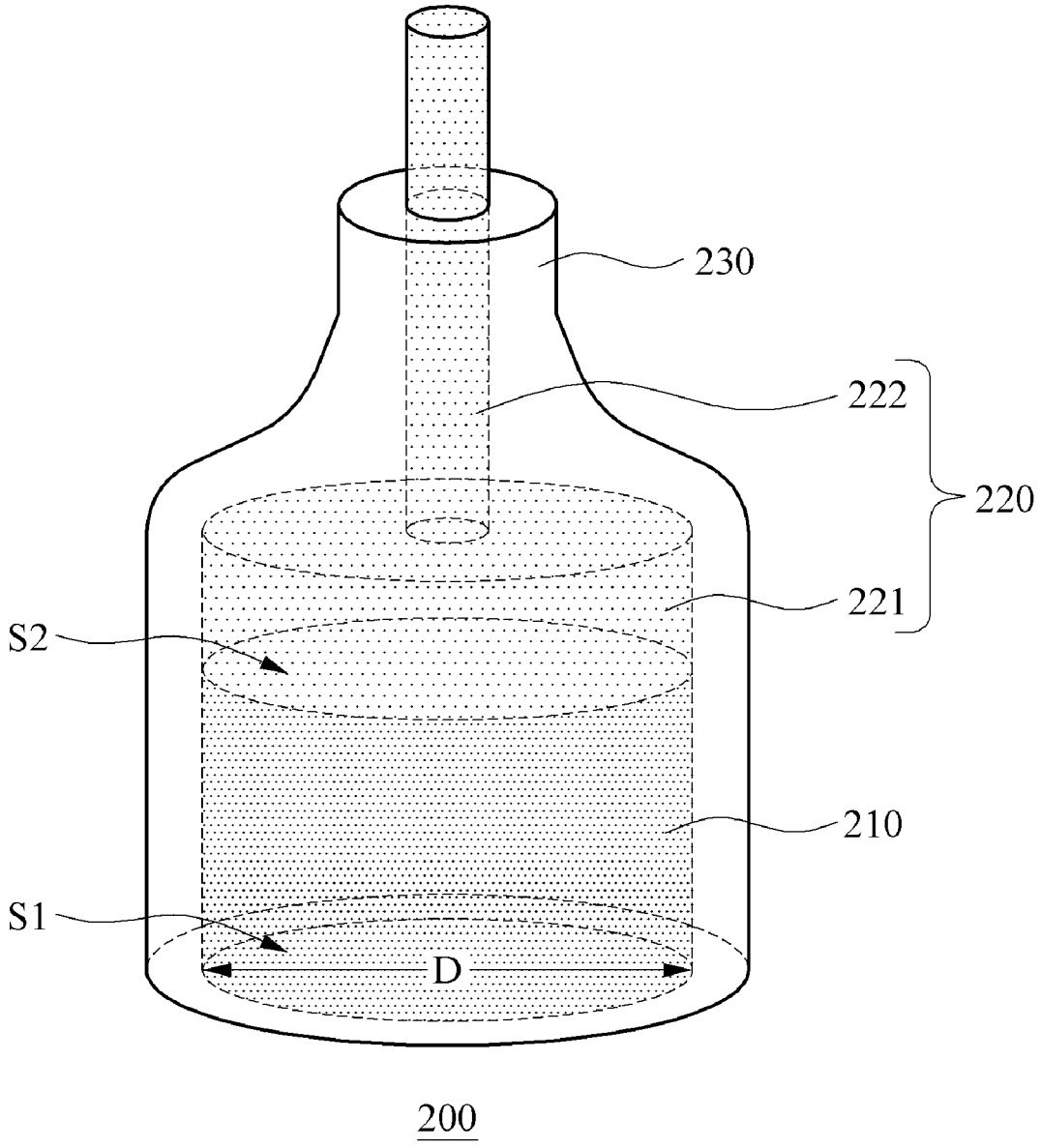
FIG. 2 illustrates a perspective of a magnet terminal.
Figure 3:
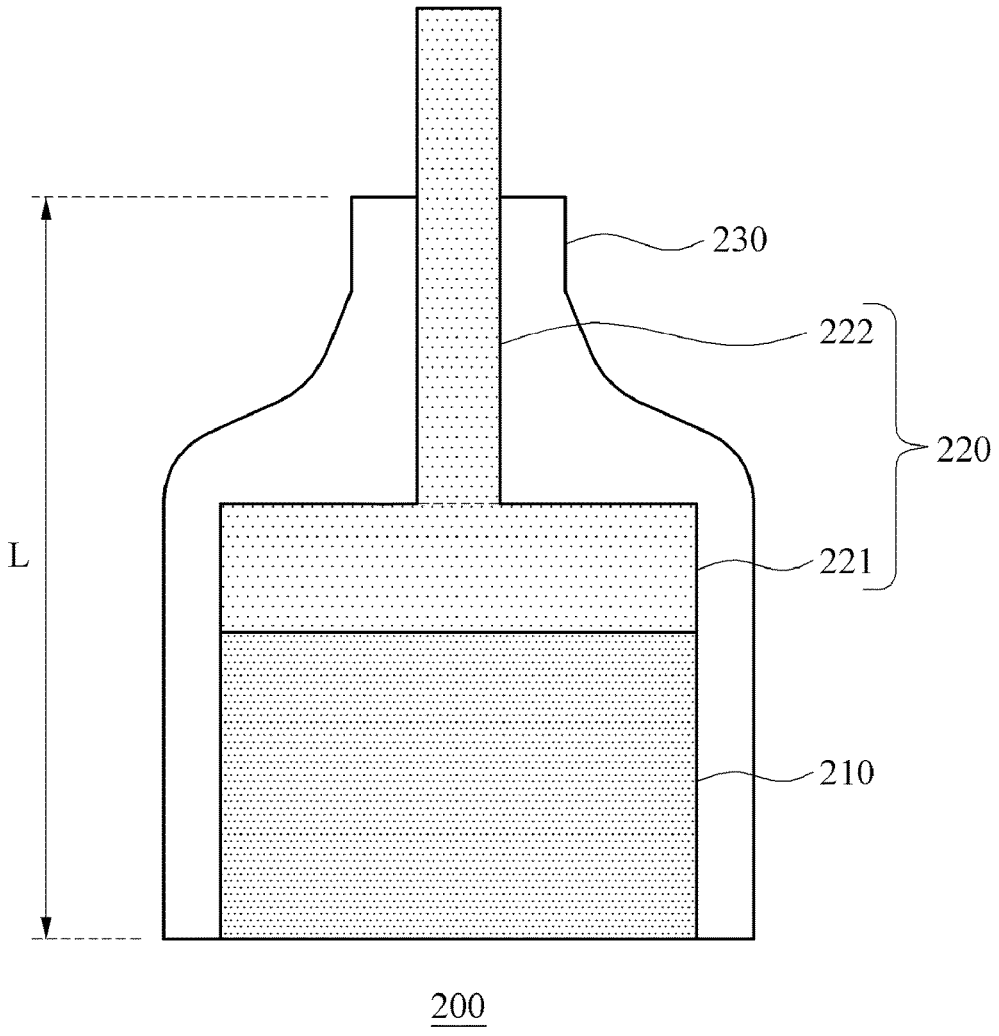
FIG. 3 illustrates a vertical section of the magnet terminal shown in FIG. 3.

FIG. 2 illustrates a perspective of a magnet terminal and FIG. 3 illustrates a vertical section of the magnet terminal shown in FIG. 3.

As shown in FIGS. 2 and 3, a magnet terminal 200 may include a magnet layer 210, a metallic structure 220, and a tube 230.

Figure 1:
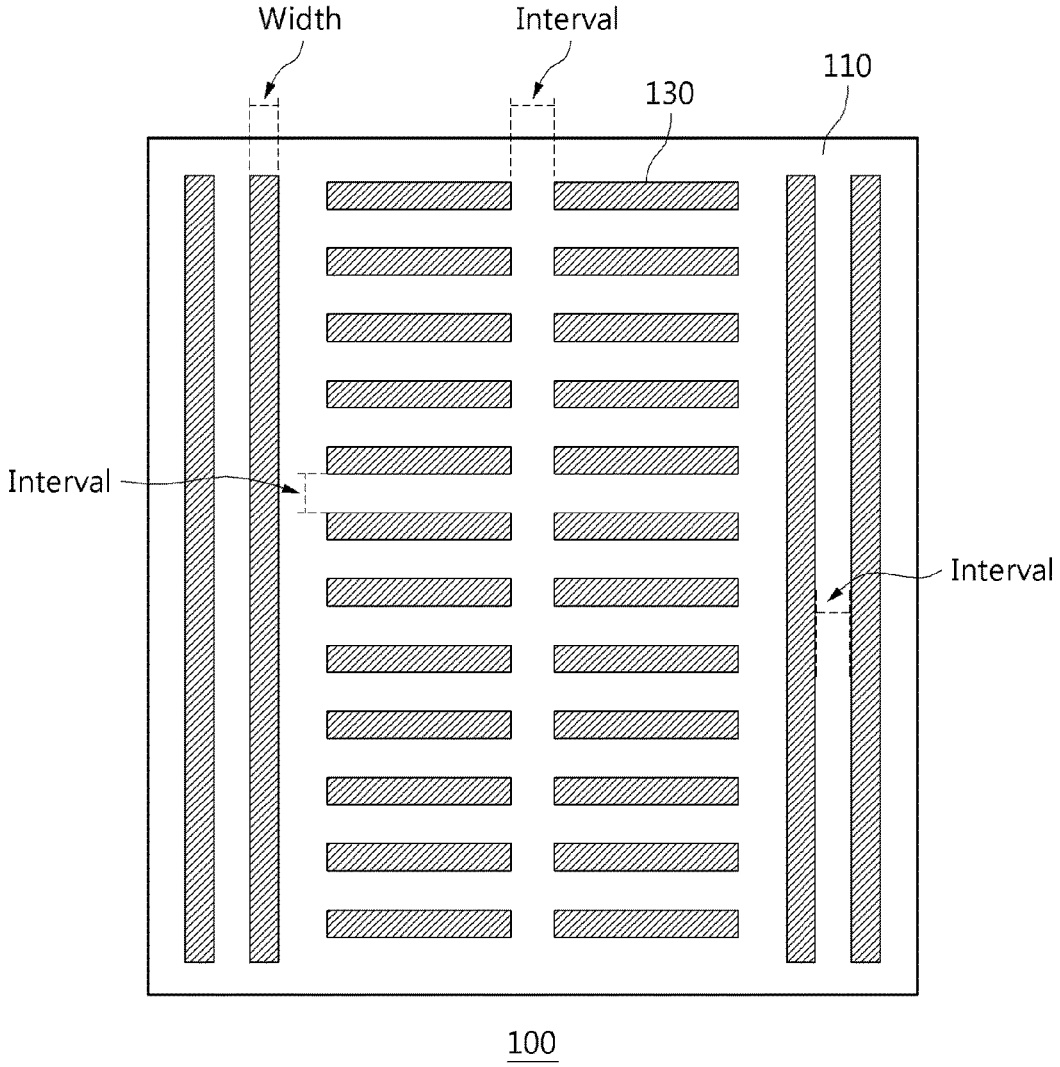
FIG. 1 illustrates an exemplary pattern of a magnet bread board as an electric/electronic circuit or component, which is attachable to a magnet terminal.

The magnet layer 210 may be formed of a magnetic material and may be connected with a component or circuit attachable to a magnet through the magnetic material. For example, the magnet layer 210 may be combined with a magnet bread board 100 shown in FIG. 1. The magnet layer 210 may be formed of a magnet of neodymium.

Although the magnet layer 210 is shaped in a cylinder, the inventive concept may not be restrictive hereto and may be variously shaped in a cube or rectangular parallelepiped.

In this scenario, the bottom surface, i.e., a first joint surface S1 connected with a component or substrate (e.g., magnet bread board) which is attachable to a magnet, may be rounded. A diameter D of the first joint surface S1 of the magnet layer 210 may be determined by a width of a conductive pad 130 of the magnet bread board 100 or an interval between the adjacent conductive pads 130. For example, the diameter D of the first joint surface S1 of the magnet layer 210 may be formed equal to or smaller than a width of the conductive pad 130. Additionally, the diameter D of the first joint surface S1 of the magnet layer 210 may be formed smaller than an interval between the adjacent conductive pads 130. By forming the diameter D of the first joint surface S1 smaller than an interval between the adjacent conductive pads 130 of the magnet bread board 100, it may be allowable to prevent an inadvertent situation that causes conduction between the conductive pads 130 according to a location of the magnet terminal 200.

Different from this scenario, the first joint surface S1 of the magnet layer 210 may be shaped in an oval or polygon. In the first joint surface S1, the crosswise width may be even different from the lengthwise width. A shape of the magnet layer 210, especially a shape of the first joint surface S1 of the magnet layer 210, may be variable dependent on a size and a shape of a connection part of a component or electric/electronic circuit which is to be connected with the magnet terminal.

The top surface of the magnet layer 210, i.e., a second joint surface S2 connected with the metallic structure 220, may be shaped in a circle, oval, or polygon. It may be desirable to from a shape and a diameter (width) of the second joint surface S2 of the magnet layer as substantially same as a shape and a diameter (width) of the first joint surface S1, but the inventive concept may not be restrictive hereto.

The metallic structure 220 may allow an electric signal to be conducted in combination with the second joint surface S2 of the magnet layer 210 and may allow connection with an electric wire.

In this scenario, the metallic structure 220 may include a first metallic structure 221 placed on the magnet layer 210, and a second metallic structure 222 placed on the first metallic structure 221. The first metallic structure 221 may conduct an electric signal from the magnet layer 210 to the second metallic structure 222. The second metallic structure 222 may conduct an electric signal from the first metallic structure 221 to the electric wire which is connected with the second metallic structure 222. The second metallic structure 222 may be connected with the electric wire through a sleeve. The second metallic structure 222 may be connected with an electric wire, without losing magnetism, even in connection with the electric wire through a solder because the second metallic structure 222 maintains an interval from the magnet layer 210. by the first metallic structure 221 It may be also permissible to connect the second metallic structure 222 with other connection terminal.

A shape of the first metallic structure 221 may be determined by a shape of the magnet layer 210. A shape of the second metallic structure 222 may be determined by a shape or combination type of an electric wire which is to be connected with the second metallic structure 222. In this scenario, the first metallic structure 221 and the second metallic structure 222 may be shaped in cylinders. The first metallic structure 221 may be larger than the second metallic structure 222 in diameter. The first metallic structure 221 is lower than the second metallic structure 222 in height (thickness). The diameters or thicknesses of the first metallic structure 221 and the second metallic structure 222 may be variable dependent on a material, function, or formation method of the metallic structure.

In some scenarios, a diameter of the first metallic structure 221 may be the same as a diameter of the magnetic layer 210. A diameter of the bottom surface of the first metallic structure 221 combined with the magnet layer 210 may be the same as a diameter of the second joint surface S2 of the magnetic layer 210, but the inventive concept may not be restrictive hereto. The first metallic structure 221 may be thinner than the magnet layer 210 in thickness.

The first metallic structure 221 and the second metallic structure 222 may be formed through one molding process. Otherwise, it may be permissible to combine the first metallic structure 221 and the second metallic structure 222 after divisionally molding them. The first metallic structure 221 and the second metallic structure 222 may be formed of the same material, but the inventive concept may not be restrictive hereto. The first metallic structure 221 and the second metallic structure 222 may be even formed of various materials in accordance with respective functions and usage.

Although not shown, a conductive adhesion layer may be further provided between the magnet layer 210 and the metallic structure 220. The conductive adhesion layer may further strengthen a physical adhesion force between the magnet layer 210 and the metallic structure 220 and may electrically connect the magnet layer 210 with the metallic structure 220.

The tube 230 may be formed to cover the outer surface of the magnet layer 210 and the metallic structure 220, and may have a cylindrical shape in which a hollow is formed. In this scenario, the tube 230 is a thermo-shrinkable tube which is shrinkable by heat. If heat is applied to the tube 230 after inserting the magnet layer 210 and the metallic structure 220 through the hollow, the tube 230 may thermally shrink and combine with the magnet layer 210 and the metallic structure 220. The tube 230 shank by heat may prevent disconnection which is caused from internal movement of the magnet layer 210 and the metallic structure 220, and may protect the magnet layer 210 and the metallic structure 220 from infiltration of diverse humidity and particles.

To improve combinational reliability between the magnet layer 210 and the first metallic structure 221, it may be desirable for a length (height) L of the tube 230 to be larger than a sum of a height of the magnet layer 210 and a height of the first metallic structure 221. A diameter of the tube 230 may be smaller at the position of combination with the second metallic structure 222 than at the position of combination with the magnet layer 210 and the first metallic structure 221. To facilitate combination with an electric wire, a length (height) L of the tube 230 may be smaller than a sum of a height of the magnet layer 210 and the metallic structure 220. The tube 230 may be formed to expose a part of connection between the second metallic structure 222 and the electric wire.

An inner shape of the tube 230 may be variable dependent on shapes of the magnet layer 210 and the metallic structure 220. An outer shape of the tube 230 may be variable dependent on an electric/electronic circuit which is combined with the bottom of the magnet terminal 200, or dependent on an electric wire which is combined with the top of the magnet terminal 200.

Although not shown in the accompanied figures, an adhesion part may be further provided to an inner surface of the tube 230 where combines with the magnet layer 210 and the metallic structure 220.

Figure 4:
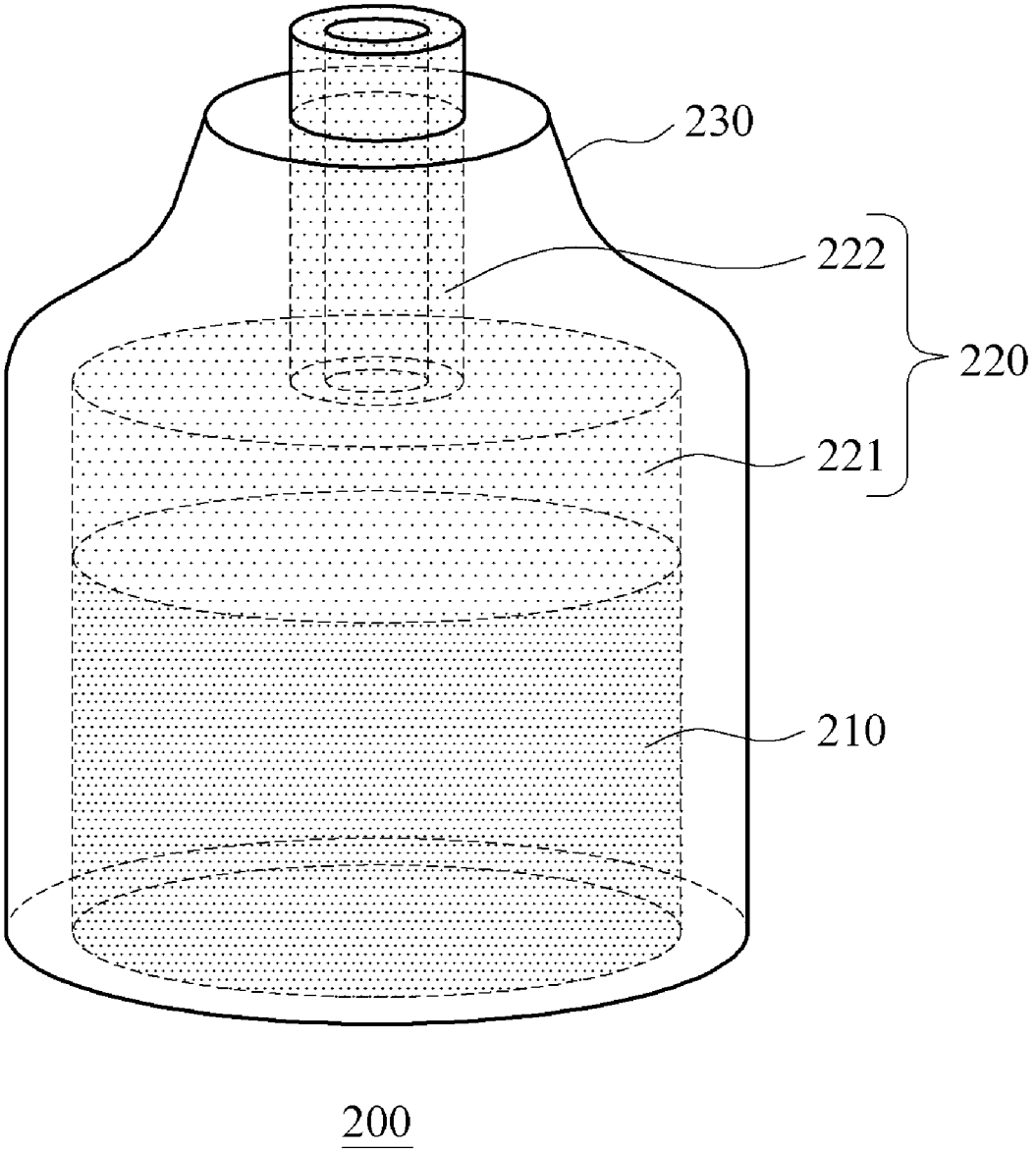
FIGS. 4 and 5 illustrate a perspective and section of a magnet terminal.
Figure 5:
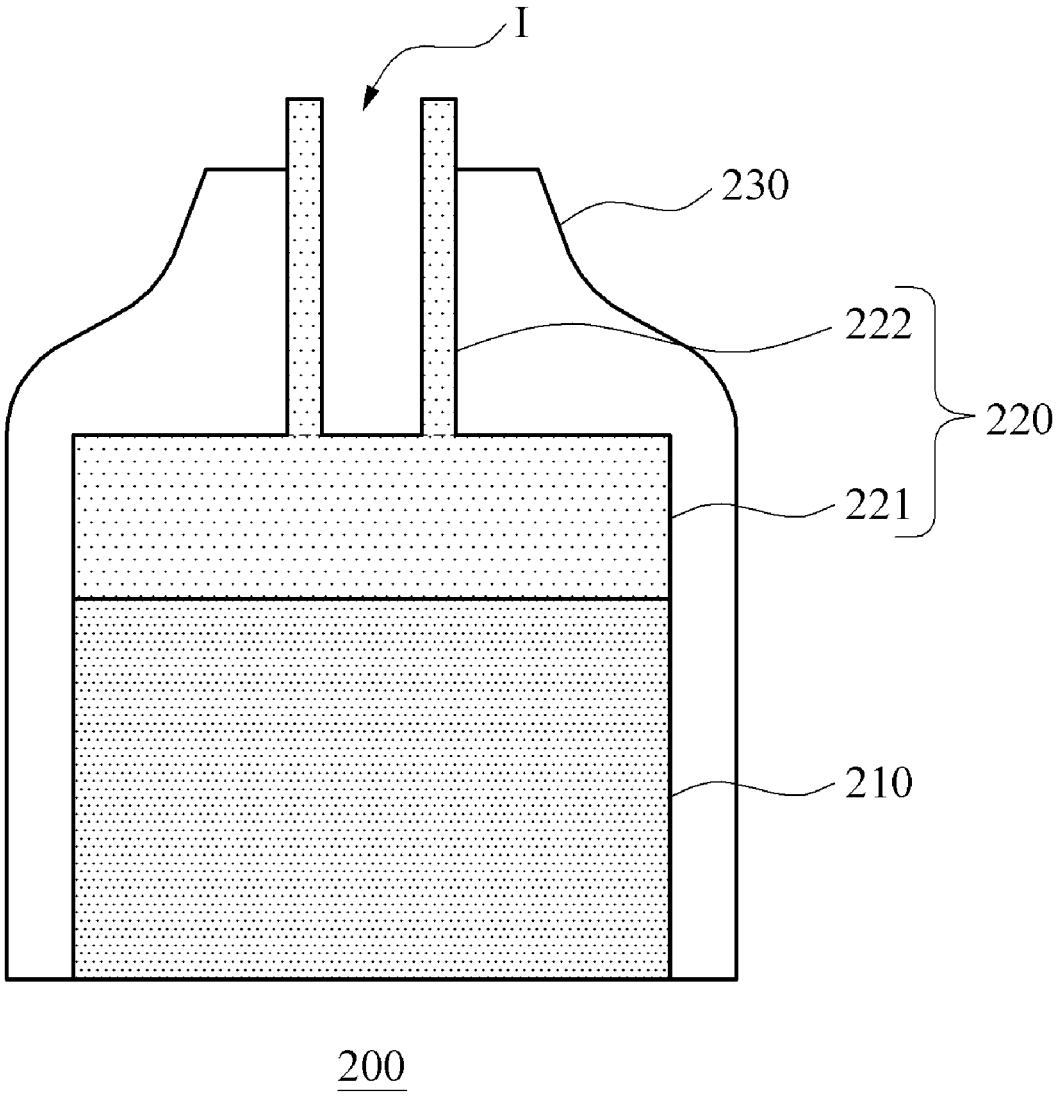

Hereinafter, a magnet terminal 200 will be described in conjunction with FIGS. 4 and 5. Comparative to FIGS. 2 and 3, the magnet terminal 200 is same with that of FIGS. 2 and 3 but different in a second metallic structure 222, thus the same configuration will not be further described later.

The second metallic structure 222 may have a cylindrical structure including an insertion part I, and conduct an electric signal from the first metallic structure 221 to the electric wire which is connected with the second metallic structure 222.

An electric wire may be fixedly inserted into the insertion part I of the second metallic structure 222. A size and a shape of the insertion part I may be variable dependent on a size, a shape, or a physical characteristics of an electric wire or a connection terminal which is combined with the second metallic structure 222.

The first metallic structure 221 may be larger than the second metallic structure 222 in diameter. The first metallic structure 221 may be lower than the second metallic structure 222 in height (thickness).

Figure 6:
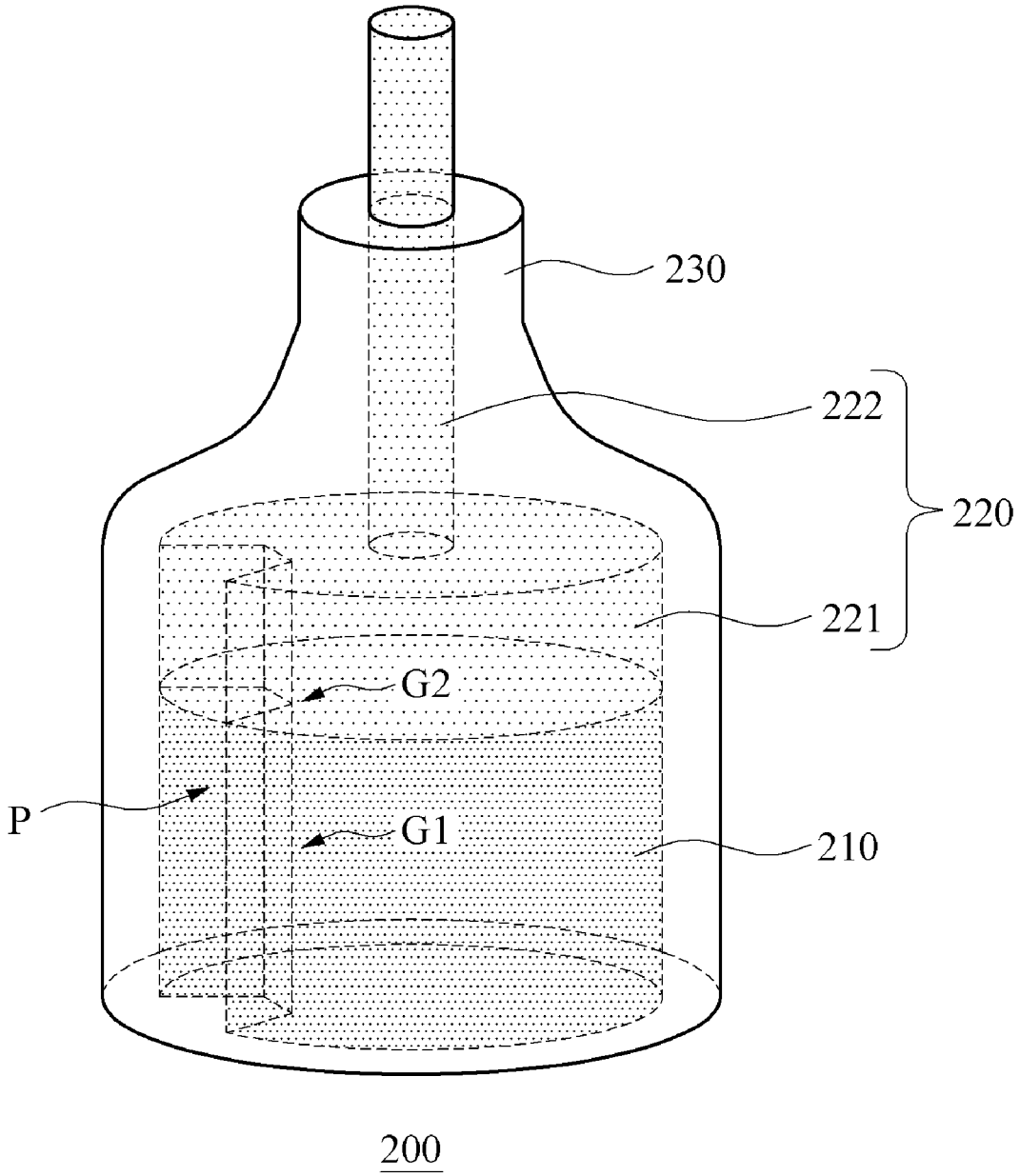
FIG. 6 illustrates a perspective of a magnet terminal.

Hereinafter, a magnet terminal 200 will be described in conjunction with FIG. 6. Comparative to FIGS. 2 and 3, the magnet terminal 200 is same with that of FIGS. 2 and 3 but different in groove parts G1 and G2 and a projection part P, thus the same configuration will not be further described later.

The magnet layer 210 and the first metallic structure 221 may further include the groove parts G1 and G2 on the outer surfaces which are combined with a tube 230. The tube 230 may further include the projection part P on the inner surface which is combined with the magnet layer 210 and the first metallic structure 221.

The projection part P of the tube 230 may be fixedly inserted into the groove part G1 of the magnet layer 210 and the groove part G2 of the first metallic structure 221. The groove parts respective to the magnet layer 210 and the first metallic structure may not be restrictive in number, and may be available with plurality. The inner projection part of the tube 230 may be formed in plurality in correspondence with a plurality of groove parts.

Different from this scenario, the magnet layer 210 and the metallic structure 220 may include their respective projection parts and the tube 230 may include groove parts corresponding to the projection parts.

Figure 7:
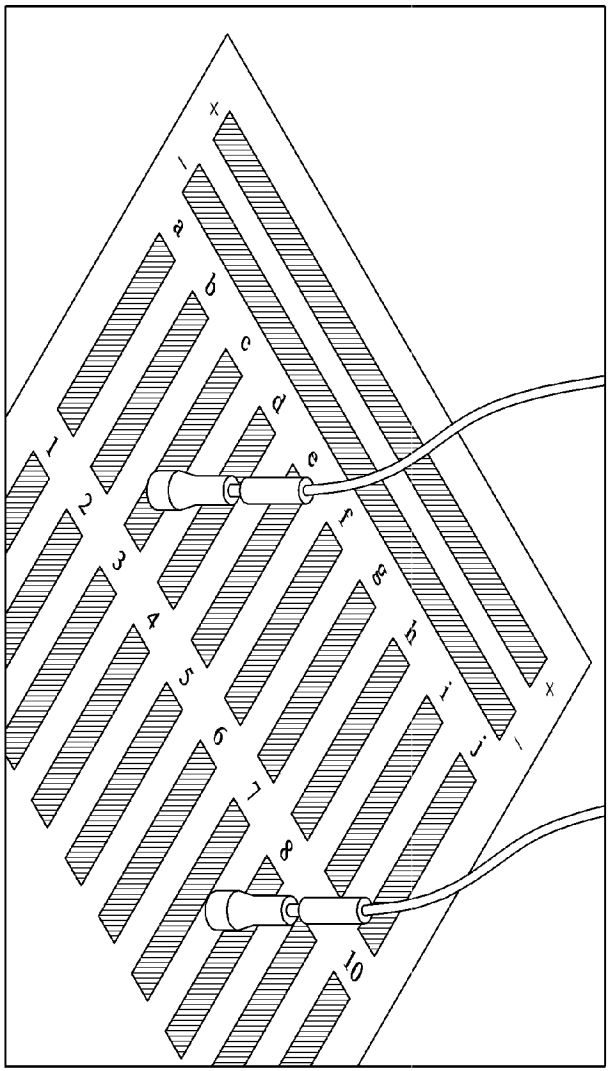
FIG. 7 illustrates an example used for connection between a magnet bread board and an electric wire through a magnet terminal.

FIG. 7 illustrates an example used for connection between a magnet bread board 100 and an electric wire through a magnet terminal. The electric wire and the magnet terminal may be formed for easy physical combination or separation. In the magnet terminal of FIG. 7, an electric wire (connection wire) may be connected with a second metallic structure of the magnet terminal through a sleeve without an additional soldering process.

Through the magnet terminal 200, a user may be able to conveniently fix an electric wire to a component or an electric/electronic circuit of the magnet bread board 100 without an additional connection set, thereby allowing other components to be connected therewith.

The magnet terminal may be utilized in various applications, e.g., in physical computing education, and connection with a magnet bread board and an open hardware unit such as Arduino.

A magnet terminal may allow easy connection with an open hardware apparatus, a magnet bread board, and a component or substrate attachable to a magnet.

Additionally, since a soldering is unnecessary in connecting an electric wire with a component or substrate attachable to a magnet, it may be accomplishable to lessen stress of soldering and to provide a magnet terminal in low cost.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

What is claimed is:

1. A magnet terminal comprising:

a magnet layer;

a metallic structure placed on the magnet layer to conduct an electric signal with the magnet layer; and a tube configured to partly cover an outer surface of the magnet layer and the metallic structure;

wherein the metallic structure comprises a first metallic structure placed on the magnet layer to conduct an electric signal with the magnet layer and a second metallic structure placed on the first metallic structure and configured to conduct an electric signal with the first metallic structure;

wherein the first metallic structure and the second metallic structure are shaped in cylinders;

wherein the first metallic structure is larger than the second metallic structure in diameter and the first metallic structure is lower than the second metallic structure in height;

wherein the tube is shaped in a cylinder that has a hollow and is a thermo-shrinking tube that is shrinkable by heat; and wherein the tube is formed to expose an upper portion of the second metallic structure to an outside.

2. The magnet terminal of claim 1, wherein the second metallic structure is shaped in a hollow cylinder including an insertion part.

3. The magnet terminal of claim 1, wherein the magnet layer and the metallic structure include one or more groove parts, wherein the tube comprises one or more projection parts combined with the one or more groove parts.

4. A jumper wire comprising:

a magnet terminal; and a connection wire to conduct an electric signal with the magnet terminal;

wherein the magnet terminal comprises a magnet layer, a metallic structure placed on the magnet layer to conduct an electric signal with the magnet layer, and a tube configure to partly cover an outer surface of the magnet layer and the metallic structure; and wherein the connection wire is physically separable from or combinable with the magnet terminal;

wherein the metallic structure comprises a first metallic structure placed on the magnet layer and configured to conduct an electric signal with the magnet layer and a second metallic structure placed on the first metallic structure and configured to conduct an electric signal with the first metallic structure;

wherein the first metallic structure and the second metallic structure are shaped in cylinders;

wherein the first metallic structure is larger than the second metallic structure in diameter and the first metallic structure is lower than the second metallic structure in height;

wherein the tube is shaped in a cylinder that has a hollow and is a thermo-shrinking tube that is shrinkable by heat; and wherein the tube is formed to expose au upper portion of the second metallic structure to an outside.

* * * * *